US012760491B2

(12) United States Patent
Lauterslager

(10) Patent No.: US 12,760,491 B2
(45) Date of Patent: Oct. 13, 2026

(54) COUPLING ARRANGEMENT FOR COUPLING A TOOL TO A MACHINE

(71) Applicant: Caterpillar Work Tools B.V., s-Hertogenbosch (NL)

(72) Inventor: Peter Renzo Maurice Lauterslager, Oss (NL)

(73) Assignee: Caterpillar Work Tools B.V., s-Hertogenbosch (NL)

( * ) Notice: Subject to any disclaimer, the term of this patent is extended or adjusted under 35 U.S.C. 154(b) by 253 days.

(21) Appl. No.: 18/289,806

(22) PCT Filed: May 6, 2022

(86) PCT No.: PCT/EP2022/025209
§ 371 (c)(1),
(2) Date: Nov. 7, 2023

(87) PCT Pub. No.: WO2022/238006
PCT Pub. Date: Nov. 17, 2022

(65) Prior Publication Data

US 2024/0279900 A1 Aug. 22, 2024

(30) Foreign Application Priority Data

May 12, 2021 (GB) ..... 2106750

(51) Int. Cl.
*E02F 3/36* (2006.01)

(52) U.S. Cl.
CPC ..... *E02F 3/3622* (2013.01); *E02F 3/3627* (2013.01); *E02F 3/3663* (2013.01)

(58) Field of Classification Search
CPC ..... E02F 3/3622–3672
See application file for complete search history.

(56) References Cited

U.S. PATENT DOCUMENTS 4,043,470 A 8/1977 Pilch
5,108,252 A 4/1992 Gilmore, Jr. et al.
(Continued)

FOREIGN PATENT DOCUMENTS

CA 2731443 A1 8/2012
CN 112627255 A 4/2021
(Continued)

OTHER PUBLICATIONS

Great Britain Search Report related to Application No. GB2106750.9; reported on Nov. 10, 2021.
(Continued)

*Primary Examiner* — Theodore N Yao

(57) ABSTRACT

A coupling arrangement for coupling a tool to a machine includes a body-bracket alignment guide mounted to a bracket and comprises at least one body-bracket guide body configured to guide a quick coupler body at least partially into a bracket cavity during coupling of front and back pin-recess assemblies. An axial alignment guide is mounted to the quick coupler and comprises at least one axial guide body. At least one mounting surface of the axial guide body is configured to restrain relative movement between the quick coupler and bracket along the back pin-recess assembly axis when the back pin-recess assembly is coupled. At least one axial ramp of the axial guide body is configured to, during coupling of the back pin-recess assembly, guide the bracket to be located adjacent to the at least one mounting surface.

15 Claims, 7 Drawing Sheets

(56) References Cited

U.S. PATENT DOCUMENTS

| | | | | |
|---|---|---|---|---|
| 5,135,347 | A | 8/1992 | Kaczmarczyk et al. | |
| 5,224,816 | A * | 7/1993 | Kaczmarczyk | E02F 3/3645 172/275 |
| 5,484,250 | A | 1/1996 | Gilmore, Jr. et al. | |
| 5,620,297 | A * | 4/1997 | Mahaney | E02F 3/627 172/275 |
| 5,890,871 | A | 4/1999 | Woerman | |
| 6,301,811 | B1 | 10/2001 | Gilmore, Jr. | |
| 6,938,514 | B1 | 9/2005 | Crane et al. | |
| 7,198,451 | B2 | 4/2007 | Wimmer | |
| 8,602,676 | B2 | 12/2013 | Stollery | |
| 9,004,845 | B2 | 4/2015 | Bernier | |
| 2003/0131682 | A1* | 7/2003 | Crane | E02F 3/3613 403/167 |
| 2006/0242865 | A1 | 11/2006 | Herguido Fo | |
| 2008/0092414 | A1 | 4/2008 | Moser et al. | |
| 2011/0262212 | A1* | 10/2011 | Luyendijk | E02F 3/3618 403/31 |
| 2012/0237283 | A1 | 9/2012 | Stollery | |
| 2019/0106858 | A1 | 4/2019 | Beaudoin et al. | |
| 2020/0308802 | A1 | 10/2020 | Thomas | |
| 2020/0392691 | A1 | 12/2020 | Lauterslager | |
| 2021/0270007 | A1* | 9/2021 | D'Amours | E02F 3/3631 |

FOREIGN PATENT DOCUMENTS

| | | | |
|---|---|---|---|
| DE | 102007023751 | A1 | 11/2008 |
| DE | 202017107699 | U1 | 1/2018 |
| EP | 0472115 | A1 | 2/1992 |
| EP | 3572588 | A1 | 11/2019 |
| EP | 3699362 | A1 | 8/2020 |
| EP | 3754118 | A1 | 12/2020 |
| WO | 9942670 | A1 | 8/1999 |
| WO | 2004001141 | A1 | 12/2003 |

OTHER PUBLICATIONS

International Search Report related to Application No. PCT/EP2022/025209; reported on Oct. 18, 2022.

* cited by examiner

COUPLING ARRANGEMENT FOR COUPLING A TOOL TO A MACHINE

CROSS-REFERENCE TO RELATED APPLICATION

This application is a USC § 371 US National Stage filing International Application No. PCT/EP2022/025209 filed on May 6, 2022 which claims priority under the Paris Convention to Great Britain Patent Application 2106750.9 filed on May 12, 2021.

TECHNICAL FIELD

This disclosure is a coupling arrangement for coupling a tool to a machine, a machine comprising a coupling arrangement and a method of operating a coupling arrangement.

BACKGROUND

Machines, particularly those in construction, mining, earth moving, goods handling, forestry, agriculture or other such industries, typically engage with a tool controlled by an operator to perform work. A variety of tools may be attached to a multi-purpose machine via a coupling arrangement for performing different types of work. Exemplary multi-purpose machines include excavators, backhoes, loaders, dozers, shovels, fellers, harvesters, material handlers and the like. One well-known coupling arrangement is a quick coupler, which allows coupling and decoupling of a tool and machine in a particularly efficient and quick operation.

The quick coupler may automatically connect a machine hydraulic system to a tool hydraulic system when the machine and tool are coupled together. U.S. Pat. App. Pub. No. US20200392691 discloses a coupling assembly for releasably mounting, and hydraulically coupling, a tool to a work machine. A mount is attachable to the work machine and configured to receive the tool in a mounted position of the tool. A rigid retaining body is movable in translation relative to the mount along a translation axis between a retaining position for retaining the tool to the mount and a release position for releasing the tool from the mount. First and second actuators are operable to move the retaining body between the retaining and release positions. A hydraulic coupling manifold is movable in translation relative to the mount along the translation axis for hydraulically coupling the tool to the machine. The hydraulic coupling manifold uses the first and second actuators as guides for moving along the translation axis.

SUMMARY

An object of the present disclosure may be to provide an improved coupling apparatus. A further object may be to provide a coupling apparatus with an automatic connection between tool and machine fluid systems. A further object may be to provide accurate alignment between the tool and machine parts of the coupling apparatus. A further object may be for such alignment to ensure a fluid tight connection between the tool and machine fluid systems.

The present disclosure provides a coupling arrangement for coupling a tool to a machine, the coupling arrangement comprising: a quick coupler for mounting to the machine comprising a quick coupler body; a bracket for mounting to the tool comprising a bracket body and a bracket cavity at least partially formed by the bracket body; front and back pin-recess assemblies engageable to couple the quick coupler and bracket together, wherein the back pin-recess assembly comprises at least one back pin extending along a back pin-recess assembly axis; a body-bracket alignment guide mounted to the bracket and comprising at least one body-bracket guide body configured to guide the quick coupler body at least partially into the bracket cavity during coupling of the front and back pin-recess assemblies; and an axial alignment guide mounted to the quick coupler and comprising at least one axial guide body comprising: at least one mounting surface configured to restrain relative movement between the quick coupler and bracket along the back pin-recess assembly axis when the back pin-recess assembly is coupled; and at least one axial ramp for, during coupling of the back pin-recess assembly, guiding the bracket to be located adjacent to the at least one mounting surface.

The present disclosure further provides an apparatus comprising a machine, a tool and a coupling arrangement coupling the tool to the machine, wherein the coupling arrangement comprises: a quick coupler comprising a quick coupler body; a bracket comprising a bracket body and a bracket cavity at least partially formed by the bracket body; front and back pin-recess assemblies engageable to couple the quick coupler and bracket together, wherein the back pin-recess assembly comprises at least one back pin extending along a back pin-recess assembly axis; a body-bracket alignment guide mounted to the bracket and comprising at least one body-bracket guide body configured to guide the quick coupler body at least partially into the bracket cavity during coupling of the front and back pin-recess assemblies; and an axial alignment guide mounted to the quick coupler and comprising at least one axial guide body comprising: at least one mounting surface configured to restrain relative movement between the quick coupler and bracket along the back pin-recess assembly axis when the back pin-recess assembly is coupled; and at least one axial ramp for, during coupling of the back pin-recess assembly, guiding the bracket to be located adjacent to the at least one mounting surface.

The present disclosure further provides a method of operating a coupling arrangement, the coupling arrangement comprising: a quick coupler comprising a quick coupler body; a bracket comprising a bracket body and a bracket cavity at least partially formed by the bracket body; front and back pin-recess assemblies, wherein the back pin-recess assembly comprises at least one back pin extending along a back pin-recess assembly axis; a body-bracket alignment guide mounted to the bracket and comprising at least one body-bracket guide body; and an axial alignment guide mounted to the quick coupler and comprising at least one axial guide body comprising at least one mounting surface and at least one axial ramp, wherein the method comprises: at least partially coupling the front pin-recess assembly; and coupling the back pin-recess assembly by: rotating the quick coupler relative to the bracket such that the quick coupler body is guided by the body-bracket alignment guide at least partially into the bracket cavity; rotating the quick coupler relative to the bracket such that the at least one axial ramp guides the bracket to be located adjacent to the at least one mounting surface such that the at least one mounting surface restrains relative movement between the quick coupler and bracket along the back pin-recess assembly axis when the back pin-recess assembly is coupled.

By way of example only, embodiments according to the present disclosure are now described with reference to, and as shown in, the accompanying drawings.

DETAILED DESCRIPTION

The present disclosure is generally directed towards a coupling arrangement comprising a quick coupler mountable to a tool bracket by front and back pin-recess assemblies. The coupling arrangement comprises body-bracket and axial alignment guides, and may comprise a pin alignment guide, configured to provide sequentially greater levels of alignment between the quick coupler and bracket as they are coupled together. The body-bracket alignment guide directs the quick coupler towards a centre of the bracket. The axial alignment guide prevents movement of the quick coupler in the bracket when fully coupled. The pin alignment guide helps ensure that the front pin-recess assembly is fully coupled during the coupling of the back pin-recess assembly.

Figure 1:
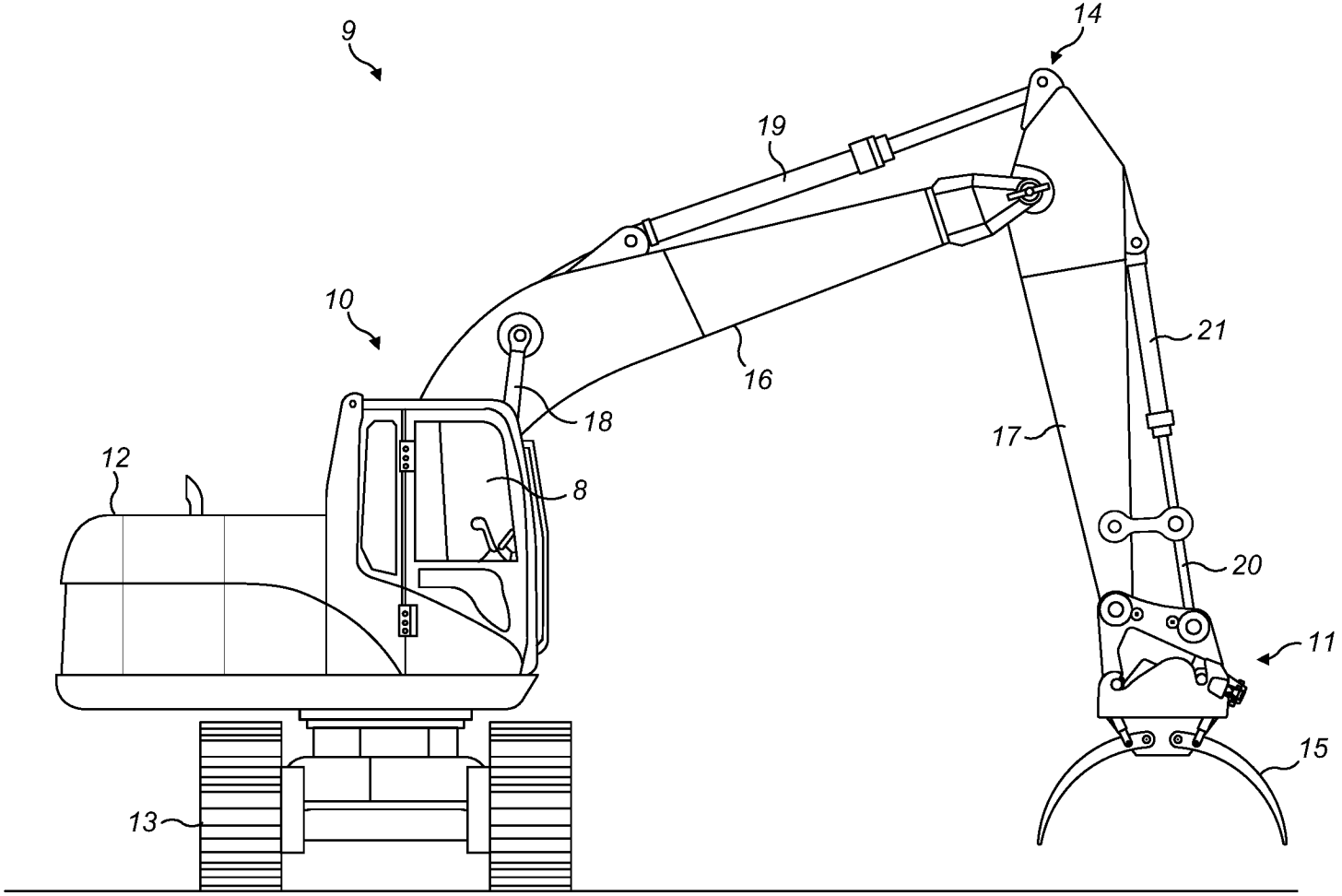
FIG. 1 is a side elevation of an embodiment of an exemplary apparatus of the present disclosure.

FIG. 1 illustrates an embodiment of an apparatus 9 comprising a machine 10, in this case an excavator, and a coupling arrangement 11 for coupling a tool 15 to the machine 10. The machine 10 may be any suitable type of machine 10, including multi-purpose machines, such as excavators, backhoes, loaders, dozers, shovels, fellers, harvesters, material handlers and other such work machines. The machine 10 may comprise a main body 12 having a cab 8 for an operator and a power unit (not shown) therein for providing power to wheels or tracks 13.

The machine 10 may comprise an arm arrangement 14 to which the tool 15 may be connected via the coupling arrangement 11. The arm arrangement 14 may comprise a boom 16, a stick 17 and a linkage arrangement 20 pivotally attached to one another. The coupling arrangement 11 may be mounted to the stick 17 and linkage arrangement 20. The arm arrangement 14 may comprise hydraulic actuators 18, 19, 21 for controlling the orientation and movement of the boom 16, stick 17 and linkage arrangement 20 and thereby the orientation and movement of the coupling arrangement 11 and tool 15.

The machine 10 may comprise a machine fluid circuit (not shown) around which fluid may be circulated. The machine 10 may comprise a control unit for controlling the machine fluid circuit automatically or based upon inputs received from an input device controllable by an operator in the main body 12, such as a joystick or at least one button. The machine fluid circuit may be connected to the first, second and third hydraulic actuators 18, 19, 21 for controlling the pivoting of the arm arrangement 14 and the tool 15. The machine fluid circuit may also comprise at least one conduit leading to or away from the at least one coupling arrangement 11 for communicating fluid to or from the at least one coupling arrangement 11 and tool 15.

The tool 15 may be of any suitable type, although the present disclosure is particularly directed towards a coupling arrangement 11 for connecting a tool 15 requiring fluid, whether for operation, actuation, lubrication, dust control during demolition or the like. The tool 15 may, for example, be a grapple as illustrated or may be a bucket, tiltable bucket, tilt rotator, hammer, handling arm, multi-processor, pulveriser, saw, shears, blower, grinder, tiller, trencher, winch, auger, broom, cutter, planer, delimber, felling head, mulcher or rake. The tool 15 may comprise a spray head or the like for providing a water spray during operation of the machine 10, for example for dust suppression. The fluid may be pressurised hydraulic fluid, water or the like.

The tool 15 may therefore comprise a tool fluid circuit (not shown), which may be fluidly connectable to the machine fluid circuit through the coupling arrangement 11. The tool fluid circuit may comprise hoses or other such conduits attached leading to the coupling arrangement 11 to enable fluid to flow to one or more tool actuators, lubrication points, spray heads or other means requiring fluid. The machine 10 can therefore operate the tool 15 based upon an input from an operator or automatically.

Figure 2:
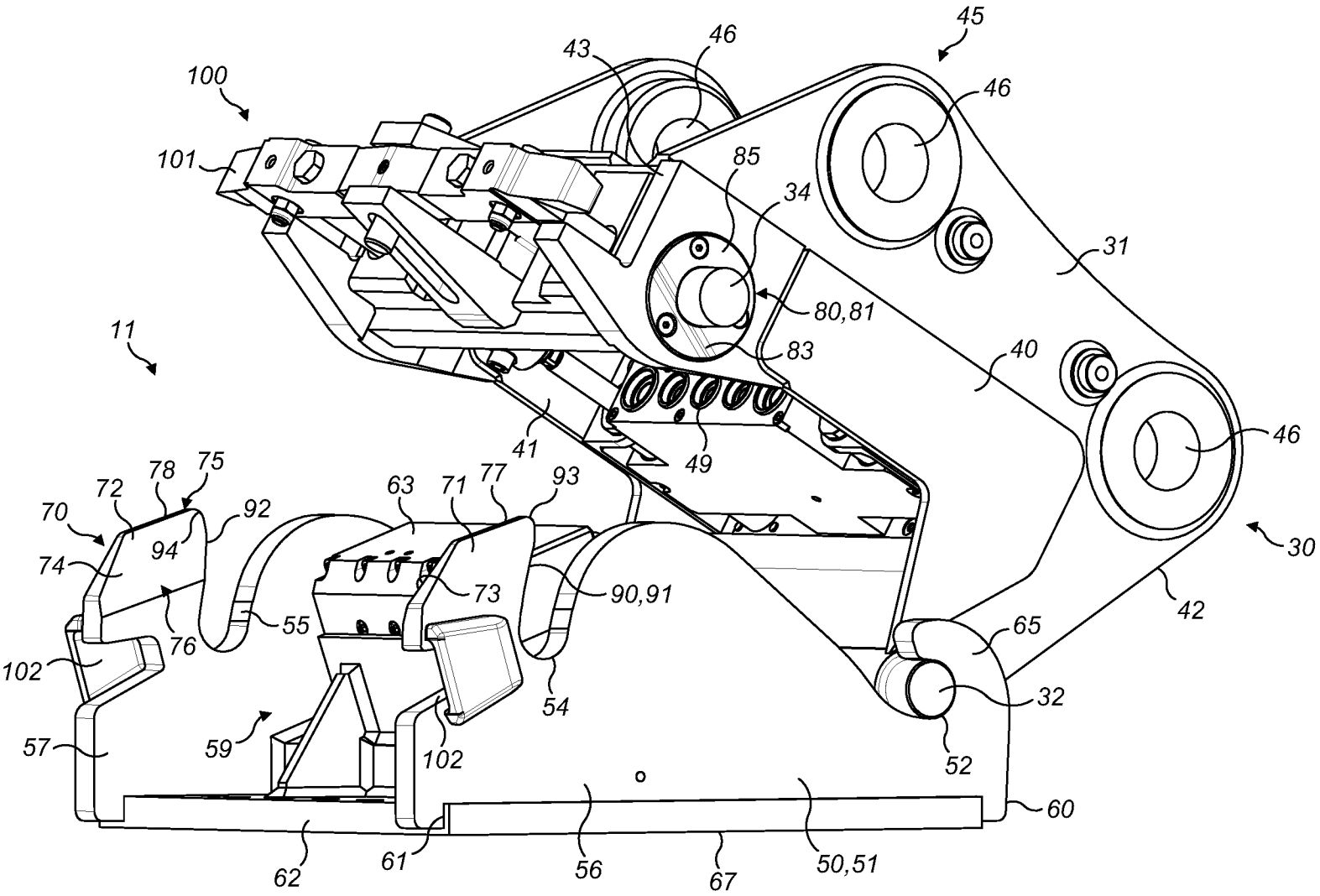
FIG. 2 is a perspective view of an embodiment of a coupling arrangement of the apparatus of FIG. 1 in an initial partially coupled configuration.
Figure 3:
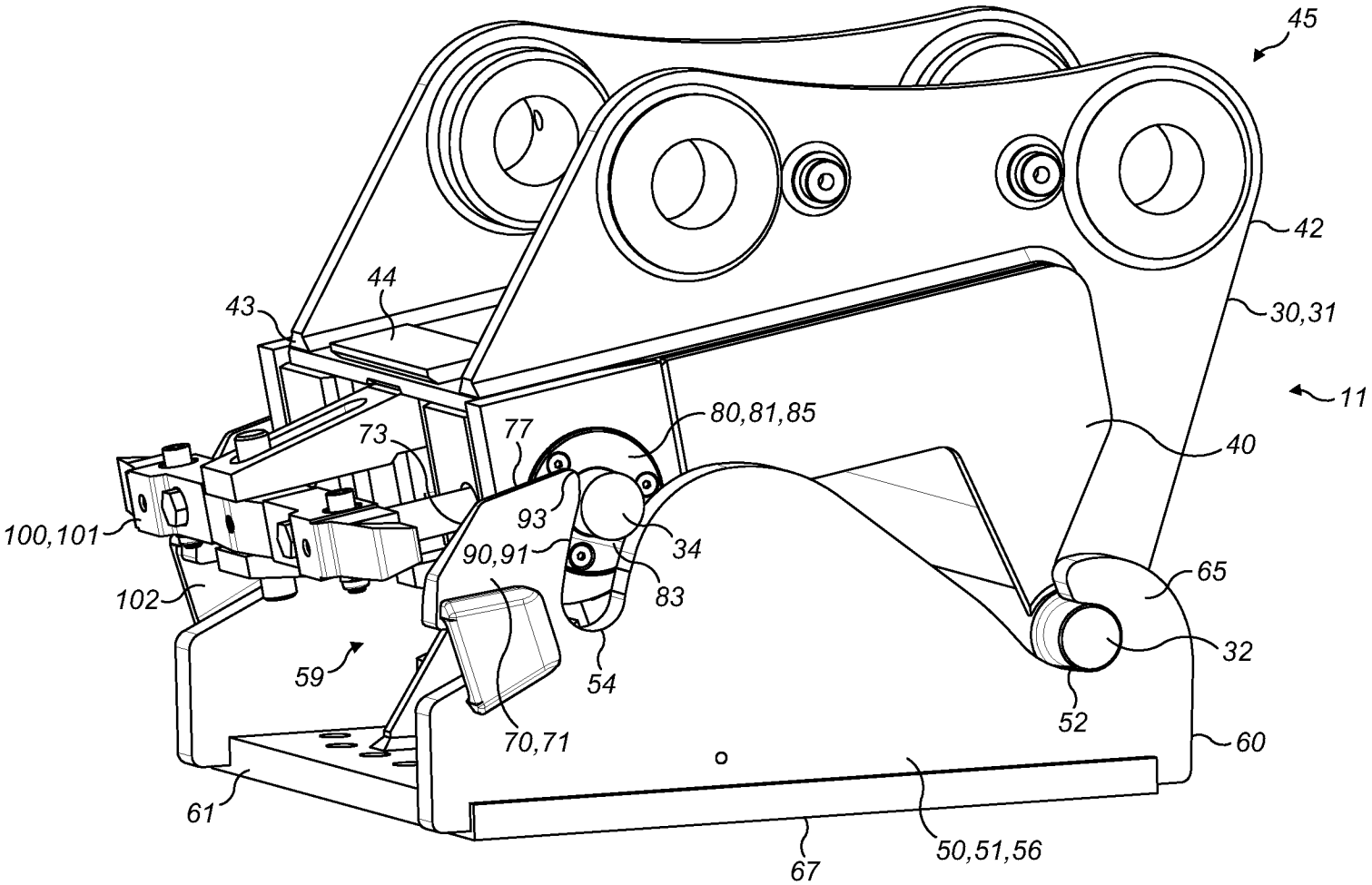
FIG. 3 is a perspective view of the coupling arrangement of FIG. 2 in an intermediate partially coupled configuration.
Figure 4:
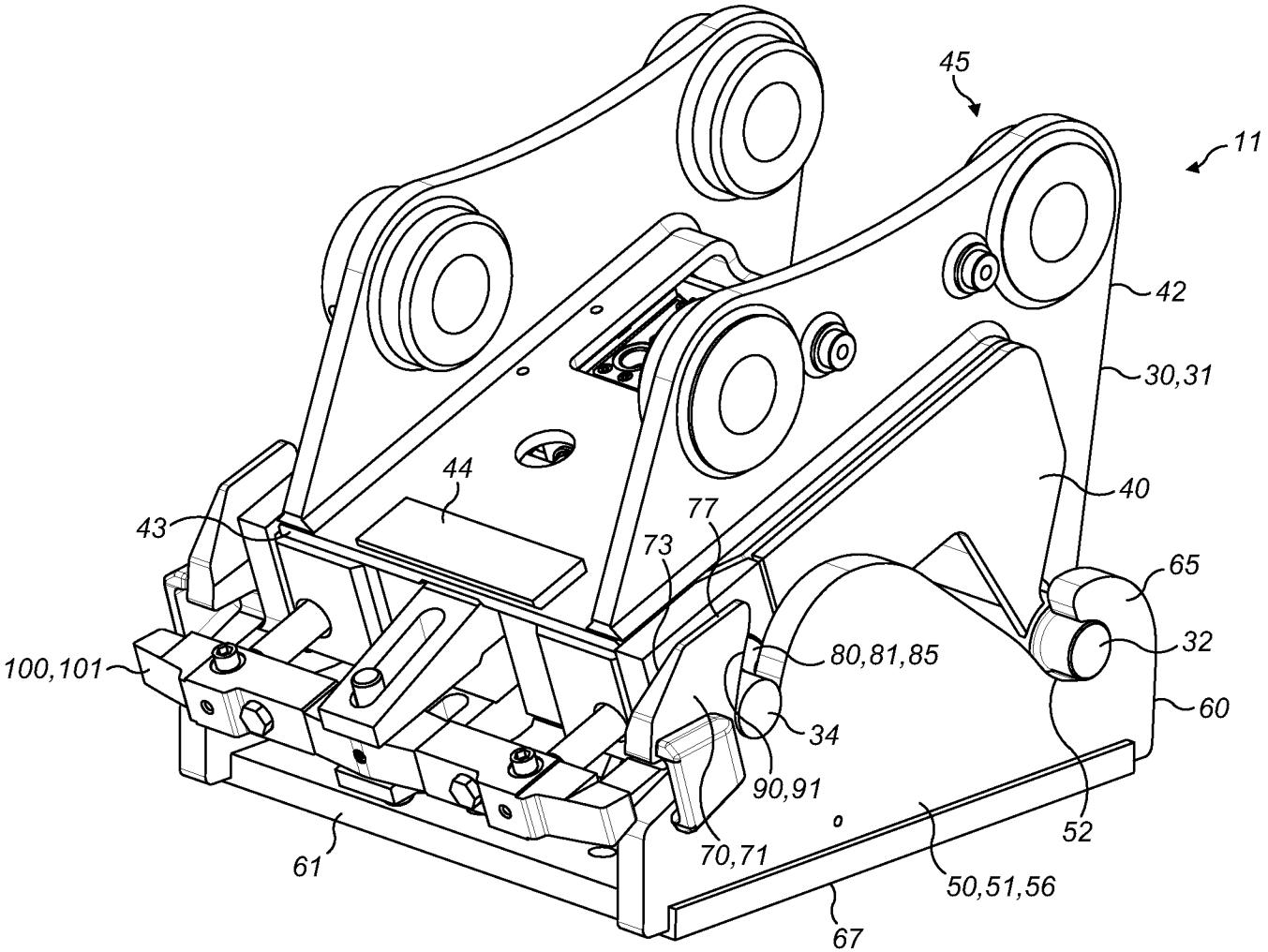
FIG. 4 is a perspective view of the coupling arrangement of FIG. 3 in a coupled configuration.
Figure 5:
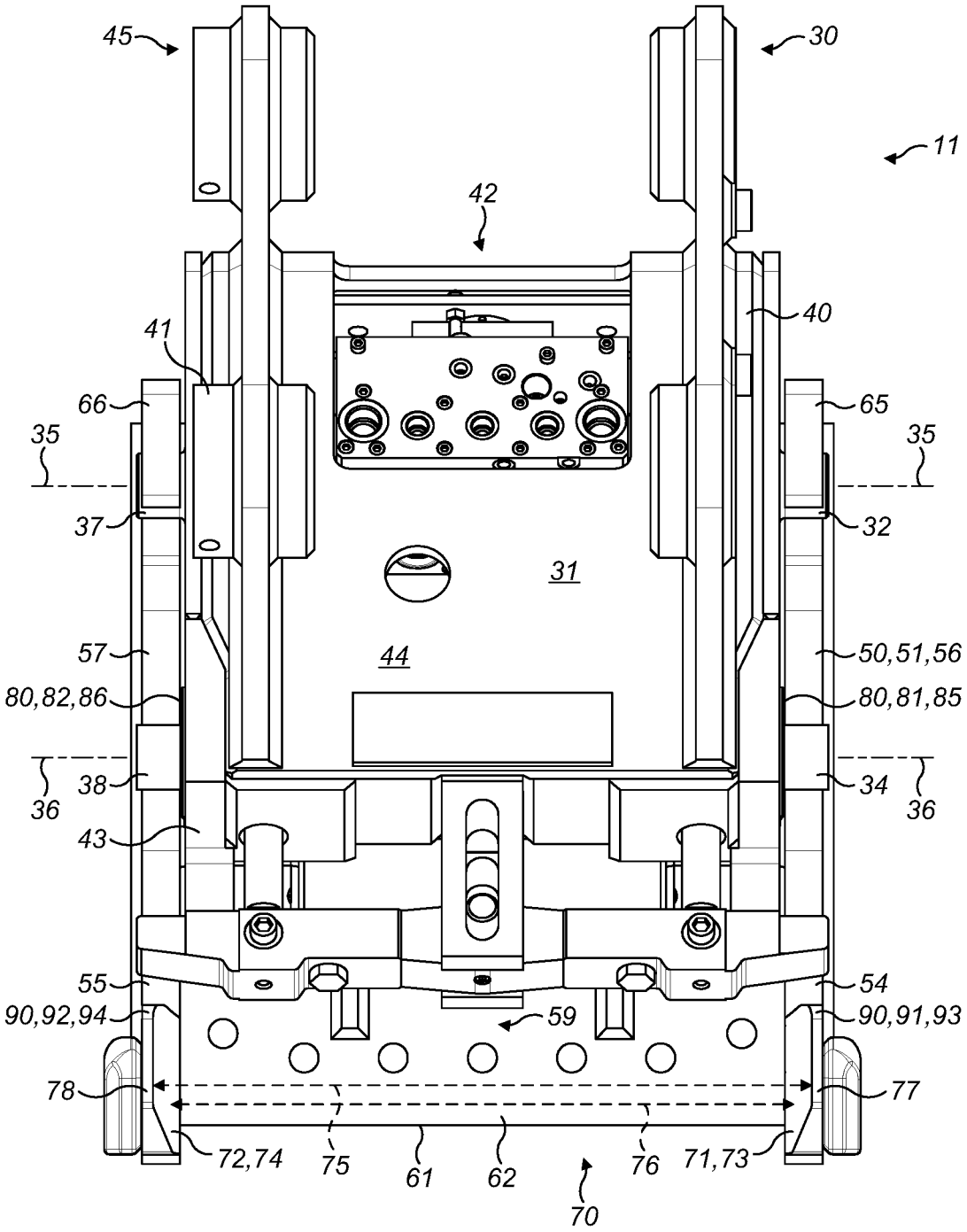
FIG. 5 is a top plan view of the coupling arrangement of FIG. 2 in the initial partially coupled configuration.

FIGS. 2 to 6 illustrate an exemplary embodiment of the coupling arrangement 11 in further detail. The coupling arrangement 11 comprises a quick coupler 30 and a bracket 50. The quick coupler 30 is mountable to the bracket 50 in the coupled configuration shown in FIG. 4. FIGS. 2 and 5 illustrate an initial configuration in which the quick coupler 30 and bracket 50 are partially coupled. FIG. 3 illustrates an intermediate configuration in which the quick coupler 30 and bracket 50 are partially coupled, but closer to the coupled configuration than the initial configuration.

Figure 6:
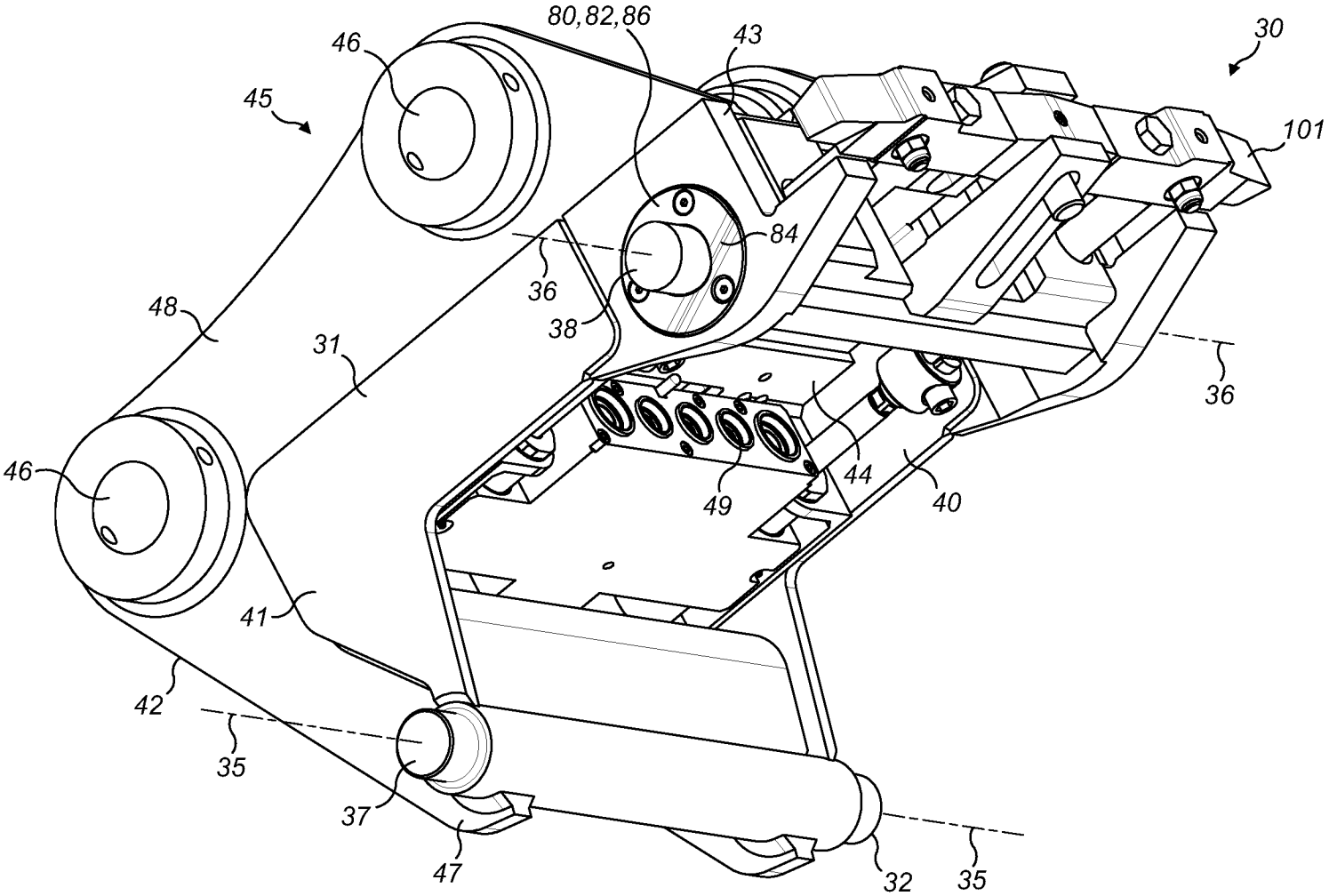
FIG. 6 is a perspective view of a quick coupler of the coupling arrangement of FIG. 2.

The quick coupler 30 is mountable to the machine 10, particularly to the arm arrangement 14 thereof. As shown in FIG. 6, the quick coupler 30 comprises a quick coupler body 31.

The quick coupler 30 may comprise at least one front pin 32, 37, such as first and second front pins 32, 37 extending from the quick coupler body 31. The at least one front pin 32, 37 may extend along a front pin-recess assembly axis 35 and the quick coupler 30 may be rotatable about the front pin-recess assembly axis 35. The first front pin 32 may extend along the front pin-recess assembly axis 35 in an opposite direction to the second front pin 37 (as shown in FIG. 6).

The quick coupler 30 may comprise at least one back pin 34, 38, such as first and second back pins 34, 38, extending from the quick coupler body 31. The at least one back pin 34, 38 extends along a back pin-recess assembly axis 36. The front and back pin-recess assembly axes 35, 36 may be parallel to one another. The first back pin 34 may extend along the back pin-recess assembly axis 36 in an opposite direction to the second back pin 38.

The quick coupler body 31 may separate the at least one front pin 32, 37 from the at least one back pin 34, 38. The first and second front pins 32, 37 and/or first and second back pins 34, 38 may be formed from a single pin member or may be formed separately as illustrated. The quick coupler body 31 may be a fabrication or welded assembly or, alternatively, may comprise a casted body or partially casted body.

The quick coupler body 31 may comprise first and second quick coupler sides 40, 41 and the front and back pins 32, 34, 37, 38 may extend from the first and second quick coupler sides 40, 41. The first front and back pins 32, 34 may extend from the first quick coupler side 40 and the second front and back pins 37, 38 may extend from the second quick coupler side 41. The front and back pins 32, 34, 37, 38 may extend outwardly from the quick coupler body 31, particularly from the first and second quick coupler sides 40, 41, parallel to the front and/or back pin-recess assembly axes 35, 36. The first and second quick coupler sides 40, 41 may extend substantially parallel to one another and may extend substantially perpendicular to the front and/or back pin-recess assembly axes 35, 36.

The first and second quick coupler sides 40, 41 may extend between front and back quick coupler ends 42, 43 of the quick coupler body 31. The at least one front pin 32, 37 may be located towards the front quick coupler end 42 and the at least one back pin 34, 38 may be located towards the back quick coupler end 43. The quick coupler body 31 may comprise a quick coupler body frame 44 extending between and separating the first and second quick coupler sides 40, 41.

The quick coupler 30 may comprise a machine connection arrangement 45 for pivotally attaching the quick coupler 30 to the machine 10, such as to the arm arrangement 14. The machine connection arrangement 45 may comprise a plurality of apertures 46 in the first and second quick coupler sides 40, 41 for receiving pins or rods mounted to the machine 10. The front and back pins 32, 34, 37, 38 may be located in a lower portion 47 of the quick coupler 30 for locating adjacent to the bracket 50 in the coupled configuration. The machine connection arrangement 45 may be located in an opposing upper portion 48 of the quick coupler 30.

The bracket 50 may be a tool bracket and may be mounted to the tool 15. The bracket 50 may be attached to or integrally formed with the tool 15. The bracket 50 may be for attaching the tool 15 to the quick coupler 30 such that the tool 15 is attached to the machine 10 for operation.

The bracket 50 comprises a bracket body 51 and a bracket cavity 59 at least partially formed by the bracket body 51. The bracket cavity 59 is configured to receive the quick coupler body 31 when the quick coupler 30 is mounted to the bracket 50. The bracket 50 may comprise a bracket base 67 for mounting to the tool 15.

The bracket 50 may comprise at least one front recess 52, 53, such as first and second front recesses 52, 53, in the bracket body 51 and may comprise at least one back recess 54, 55, such as first and second back recesses 54, 55, in the bracket body 51. The at least one front recess 52, 53 may be configured to receive the at least one front pin 32, 37 such that the at least one front pin 32, 37 is rotatable about the front pin-recess assembly axis 35 when engaged in the at least one front recess 52, 53.

The at least one back recess 54, 55 may be configured to receive and engage with the at least one back pin 34, 38 when the quick coupler 30 is rotated relative to the bracket 50 about the front pin-recess assembly axis 35. The at least one back recess 54, 55 may be configured to receive the at least one back pin 34, 38 when the at least one front pin 32, 37 is at least partially engaged in the at least one front recess 52, 53 and when the quick coupler 30 is rotated about the front pin-recess assembly axis 35 the at least one back pin 34, 38 is directed towards and into the at least one back recess 54, 55.

The bracket body 51 may separate the at least one front recess 52, 53 from the at least one back recess 54, 55. The first and second front recesses 52, 53 and/or first and second back recesses 54, 55 may be formed from a single recess (e.g. in the bracket body 51) or may be formed separately as illustrated.

The bracket body 51 may comprise first and second bracket side walls 56, 57 and the front and back recesses 52, 53, 54, 55 may be in the first and second bracket side walls 56, 57. In particular, the first front and back recesses 52, 54 may be in the first bracket side wall 56 and the second front and back recesses 53, 55 may be in the second bracket side wall 57. The front and back recesses 52, 53, 54, 55 may extend downwardly into the first and second bracket side walls 56, 57, such as into upper edges thereof, in a direction away from the quick coupler 30 and/or towards the tool 15 when the quick coupler 30 and bracket 50 are mounted to one another. The front and back recesses 52, 53, 54, 55 may be located in the upper edges of the first and second bracket side walls 56, 57, which may oppose the bracket base 67.

The first and second bracket side walls 56, 57 may extend substantially parallel to one another and, when the quick coupler 30 and bracket 50 are in the coupled configuration, may extend substantially parallel and adjacent to the first and second quick coupler sides 40, 41.

The first and second bracket side walls 56, 57 may extend between bracket front and back ends 60, 61 of the bracket body 51. The at least one front recess 52, 53 may be located towards the bracket front end 60 and the at least one back recess 54, 55 may be located towards the bracket back end 61.

The bracket body 51 may comprise a bracket body frame 62 extending between and separating the first and second bracket side walls 56, 57. The bracket cavity 59 may be formed by and between the first and second bracket side walls 56, 57 and the bracket body frame 62.

The quick coupler 30 may comprise a coupling fluid connector 49, which may be in fluid communication with the machine fluid circuit. The coupling fluid connector 49 may comprise a plurality of fluid ports and may be mounted to the quick coupler body 31, such as to the quick coupler body frame 44, for facing the bracket 50 when the bracket 50 and quick coupler 30 are in the coupled configuration. The bracket 50 may comprise a bracket fluid connector 63, which may be in fluid communication with the tool fluid circuit. The machine fluid connector 63 may comprise a plurality of fluid ports and may be mounted to the bracket body 51, such as to the bracket body frame 62, for facing the quick coupler 30 when the bracket 50 and quick coupler 30 are in the coupled configuration. The coupler and bracket fluid connectors 49, 63 may be configured on the quick coupler and bracket bodies 31, 51 respectively so as to fluidly connect with one another when the bracket 50 and quick coupler 30 are in the coupled configuration. Thus, in the coupled configuration the operator can control the tool 15 by means of the machine and tool fluid circuits.

The coupling arrangement 11 comprises front and back pin-recess assemblies 25, 26 engageable to couple the quick coupler 30 and bracket 50 together. The front pin-recess assembly 25 may comprise the at least one front pin 32, 37 engageable and rotatable in the at least one front recess 52, 53. The back pin-recess assembly 26 comprises the at least one back pin 34, 38 extending along the back pin-recess assembly axis 36 and may comprise the at least one back recess 54, 55. In the coupled configuration the front and back pin-recess assemblies 25, 26 are fully engaged by virtue of the at least one front pin 32, 37 being mounted in the at least one front recess 52, 53 and the at least one back pin 34, 38 being mounted in the at least one back recess 54, 55. The front pin-recess assembly 25 may be disengageable only if the back pin-recess assembly 26 is disengaged.

The at least one front recess 52, 53 may be formed by at least one hook 65, 66. The at least one hook 65, 66 may be configured such that the front pin-recess assembly 25 can be uncoupled only when the back pin-recess assembly 26 is uncoupled. In particular, the first and second front recesses 52, 53 may be formed by first and second hooks 65, 66 (such as in the interior edge of such hooks 65, 66) formed by the first and second bracket side walls 56, 57. The first and second hooks 65, 66 may at least partially enclose a top portion of the first and second front pins 32, 37 when the front pin-recess assembly 25 is engaged such that the first and second front pins 32, 37 cannot move upwardly away from the bracket 50 and tool 15, which may be in a direction perpendicular to the front pin-recess assembly axis 35. The entrances to the first and second front recesses 52, 53 may therefore face away from the bracket front end 60 towards the bracket back end 61.

The at least one back recess 54, 55 may be formed in the bracket body 51 such that, when the front pin-recess assembly 25 is at least partially engaged, the at least one back pin 34, 38 is slidable into and along the at least one back recess 54, 55 as the quick coupler 30 is rotated about the front pin-recess assembly axis 35. The first and second back recesses 54, 55 may comprise substantially elongate slots extending into the first and second bracket side walls 56, 57 and towards the bracket base 67.

The coupling arrangement 11 further comprises a body-bracket alignment guide 70 mounted to the bracket 50. The body-bracket alignment guide 70 may be configured for initially roughly aligning the quick coupler 30 with the bracket 50 during coupling. The body-bracket alignment guide 70 comprises at least one body-bracket guide body 71, 72 configured to guide the quick coupler body 31 at least partially into the bracket cavity 59 during coupling of the front and back pin-recess assemblies 25, 26, such as when the coupling arrangement 11 is configured from the initial configuration to the coupled configuration.

The body-bracket alignment guide 70 may comprise first and second body-bracket guide bodies 71, 72 or fins extending from the first and second bracket side walls 56, 57 away from the bracket base 67. The first and second body-bracket guide bodies 71, 72 may extend adjacent to the first and second back recesses 54, 55 and may extend on either side of the quick coupler body 31 when the quick coupler 30 and bracket 50 are mounted to one another. The first and second body-bracket guide bodies 71, 72 may comprise first and second upper body-bracket guide edges 77, 78 distal to the bracket base 67.

The at least one body-bracket guide body 71, 72 may comprise at least one body-bracket guide chamfered surface 73, 74 or ramp and the at least one body-bracket guide chamfered surface 73, 74 may be for contacting the quick coupler body 31 to guide the quick coupler body 31 at least partially into the bracket cavity 59. The first and second body-bracket guide bodies 71, 72 may comprise first and second body-bracket guide chamfered surfaces 73, 74. The first and second body-bracket guide chamfered surfaces 73, 74 may face inwardly towards each other across the bracket cavity 59. The first and second body-bracket guide chamfered surfaces 73, 74 may extend from the first and second upper body-bracket guide edges 77, 78 into the bracket cavity 59 and may extend along the inside of the first and second bracket side walls 56, 57 and first and second body-bracket guide bodies 71, 72.

The first and second body-bracket guide chamfered surfaces 73, 74 may form a body-bracket alignment opening 75 leading to a body-bracket alignment spacing 76 between them for receiving the quick coupler body 31. The body-bracket alignment opening 75 may be formed between the first and second upper body-bracket guide edges 77, 78. The body-bracket alignment spacing 76 may decrease in width from the body-bracket alignment opening 75 into the bracket cavity 59 such that, as the quick coupler body 31 passes through the body-bracket alignment opening 75 into and through the body-bracket alignment spacing 76, the movement of the quick coupler 30 along the back pin-recess assembly axis 36 is increasingly restricted. Thus the quick coupler 30 may become more centralised in the bracket 50 as it moves into the body-bracket alignment spacing 76.

The at least one body-bracket guide chamfered surface 73, 74 may extend from the at least one back recess 54, 55 to the bracket back end 61. The first and second body-bracket guide bodies 71, 72 may comprise fins extending substantially along and between the first and second back recesses 54, 55 and the bracket back end 61. The body-bracket alignment guide 70, for example the at least one body-bracket guide chamfered surface 73, 74 and first and second body-bracket guide bodies 71, 72 thereof, may be located on the opposing side of the at least one back recess 54, 55 to the at least one front recess 52, 53 as illustrated.

The coupling arrangement 11 further comprises an axial alignment guide 80. The axial alignment guide 80 may be configured for a final fine alignment between the quick coupler 30 and the bracket 50 during coupling to ensure that a fluid tight connection between the coupler and bracket fluid connectors 49, 63 is maintained. The axial alignment guide 80 may be configured to, when the coupling arrangement 11 is being configured from the initial configuration to the coupled configuration, guide the quick coupler body 31 when it is already at least partially in the bracket cavity 59.

The axial alignment guide 80 comprises at least one axial guide body 81, 82, such as first and second axial guide bodies 81, 82, mounted to the quick coupler body 31. The at least one axial guide body 81 may be configured to be mounted between the quick coupler body 31 and bracket body 51 when the front and back pin-recess assemblies 25, 26 are coupled in the coupled configuration to restrict axial movement of the quick coupler 30 relative to the bracket 50 along the back pin-recess assembly axis 36. Therefore, a fluid connection between the coupler and bracket fluid connectors 49, 63 can be maintained.

The first and second axial guide bodies 81, 82 are each located adjacent to and/or extend at least partially around the first and second back pins 34, 38 respectively. The first and second axial guide bodies 81, 82 may extend away from the first and second back pins 34, 38 by up to about a diameter of the first and second back pins 34, 38. The at least one axial guide body 81, 82 may be annular shaped and may integrated with the quick coupler body 31 or, as illustrated, may comprise at least one annular disc.

The at least one axial guide body 81, 82 comprises at least one mounting surface 85, 86 configured to restrain relative movement between the quick coupler 30 and bracket 50 along the back pin-recess assembly axis 36 when the back pin-recess assembly 26 is coupled. In particular, when the back pin-recess assembly 26 is coupled and in the coupled configuration the at least one mounting surface 85, 86 may substantially contact the bracket body 51. The at least one mounting surface 85, 86 may be configured to restrain relative movement such that the fluid coupling between the coupling and bracket fluid connectors 49, 63 is maintained when the front and back pin-recess assemblies 25, 26 are coupled. The at least one mounting surface 85, 86 may comprise first and second mounting surfaces 85, 86 facing outwardly from the quick coupler body 31, particularly from the quick coupler sides 40, 41, for contacting the first and second bracket side walls 56, 57 respectively when the quick coupler 30 and bracket 50 are in the coupled configuration and/or when the back pin-recess assembly 26 is coupled.

The at least one axial guide body 81, 82 comprises at least one axial ramp 83, 84 for, during coupling of the back pin-recess assembly 26, guiding the bracket 50 to be located adjacent to the at least one mounting surface 85, 86. The at least one axial ramp 83, 84 may comprise first and second axial ramps 83, 84 formed in the first and second axial guide bodies 81, 82 respectively. The at least one axial ramp 83, 84 may face towards the bracket 50, such as towards the bracket base 67, when the quick coupler 30 is mounted to the bracket 50 in the coupled configuration and/or the front and back pin-recess assemblies 25, 26 are coupled.

The at least one axial ramp 83, 84 may extend to the at least one mounting surface 85, 86 and may ramp up to the at least one mounting surface 85, 86. The at least one axial ramp 83, 84 may comprise a chamfered surface in the at least one axial guide body 81, 82. As illustrated, the first and second axial ramps 83, 84 may extend around a smaller portion of the first and second back pins 34, 38 respectively than the first and second mounting surfaces 85, 86. The first and second axial ramps 83, 84 may be configured substantially adjacent to the portions of the first and second back pins 34, 38 which initially meet the bracket 50 as the back pin-recess assembly 26 is coupled.

The coupling arrangement 11 may further comprise a pin alignment guide 90. The pin alignment guide 90 may be configured to ensure that the front pin-recess assembly 25 is completely engaged as the back pin-recess assembly 26 is engaged. In particular, as the back pin-recess assembly 26 is engaged, the pin alignment guide 90 may be configured to direct the movement of the quick coupler 30 relative to the bracket 50 such that the front pin-recess assembly 25 is fully engaged. As a result, any misalignment in the front pin-recess assembly 25 can be reduced. The pin alignment guide 90 may therefore be configured to, when the coupling arrangement 11 is configured from the initial configuration to the coupled configuration, guide the at least one back pin 34, 38 towards and/or further into the at least one back recess 54, 55 such that the quick coupler 30 is guided relative to the bracket 50 to fully couple the at least one front pin 32, 37 in the at least one front recess 52, 53.

The pin alignment guide 90 may comprise at least one guiding edge 91, 92 of the bracket body 51 and/or first and second body-bracket guide bodies 71, 72. The at least one guiding edge 91, 92 may comprise first and second guiding edges 91, 92 in the first and second bracket side walls 56, 57 respectively. The at least one guiding edge 91, 92 may be formed at an edge of the at least one back recess 54, 55 and may comprise an edge of the at least one back recess 54, 55 facing towards the front pin-recess assembly 25 and/or at least one front recess 52, 53. The first and second guiding edges 91, 92 may extend from the first and second back recesses 54, 55 to the first and second upper body-bracket guide edges 77, 78. The first and second guiding edges 91, 92 may comprise first and second convex corners 93, 94 leading to the first and second upper body-bracket guide edges 77, 78.

The at least one guiding edge 91, 92 may be configured to be contacted by the at least one back pin 34, 38 as the at least one back pin 34, 38 is slid into the at least one back recess 54, 55. The at least one guiding edge 91, 92 may be on the opposing side of the at least one back recess 54, 55 to the at least one front recess 52, 53.

The coupling arrangement 11 may further comprise a retaining arrangement 100 for maintaining the coupling arrangement 11 in the coupled configuration. In particular, the retaining arrangement 100 may be configurable to keep the back pin-recess assembly 26 coupled. The retaining arrangement 100 may comprise at least one retaining arm 101, which may be mounted to the quick coupler 30, mountable in at least one retaining recess 102, which may be in the bracket 50 such as adjacent to the body-bracket alignment guide 70 to maintain the back pin-recess assembly 26 in the coupled configuration. The at least one retaining arm 101 may be moveable perpendicular to the back pin-recess assembly axis 36. The back pin-recess assembly 26 may only be fixed in its coupled configuration when the retaining arrangement 100 is engaged.

In the present disclosure the terms "front" and "back" are merely used as nomenclature and it will be appreciated that front and back of the components of the coupling arrangement 11 will depend upon the orientation of the coupling arrangement 11 in use relative to an observer.

Figure 7:
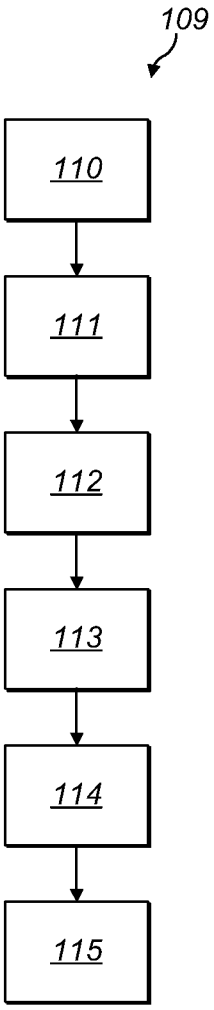
FIG. 7 is a flow diagram illustrating an exemplary method of the present disclosure.

FIG. 7 is a flow chart illustrating an exemplary embodiment of a method of 109 operating the coupling arrangement 11. Initially the tool 15 is not coupled to the machine 10 and the quick coupler 30 and bracket 50 are not coupled to one another.

In a front pin-recess assembly 25 coupling step 110, the front pin-recess assembly 25 is at least partially coupled such that the coupling arrangement 11 is in the partially coupled configuration illustrated in FIGS. 2 and 5. The front pin-recess assembly 25 may need to be at least partially coupled before the back pin-recess assembly 26 because the front pin-recess assembly 25 cannot be coupled or uncoupled whilst the back pin-recess assembly 26 is coupled. The operator may operate the input device to control the arm arrangement 14 such that the quick coupler 30 is adjacent to the bracket 50. The front pin-recess assembly 25 may be at least partially coupled by the at least one front pin 32, 37 being at least partially mounted in the at least one front recess 52, 53. The front pin-recess assembly 25 may be only partially engaged if the at least one front pin 32, 37 has not travelled as far as is possible into the at least one front recess 52, 53. For example, if the quick coupler 30 and bracket 50 are misaligned with one another then only the first front pin 32 may be engaged in the first front recess 52 and the second front pin 37 may not be engaged in the second front recess 53 or vice-versa.

In back pin-recess assembly 26 coupling steps 111, 112 and 113, the back pin-recess assembly 26 is coupled such that the coupling arrangement 11 moves to the coupled configuration shown in FIG. 4 via the intermediate configuration shown in FIG. 3. During steps 111, 112, 113, the front pin-recess assembly 25 may be fully coupled if it was only partially coupled initially. The quick coupler 30 may be rotated about the front pin-recess assembly axis 35 such that the back pin-recess assembly 26 is coupled. In particular, during such rotation the at least one back pin 34, 38 may be moved towards and into the at least one back recess 54, 55 whilst the quick coupler body 31 may be at least partially located in the bracket cavity 59. During such rotation the first, second and pin alignment guides 70, 80, 90 may be configured to bring the quick coupler 30 and bracket 50 into alignment with one another such that the coupler and bracket fluid connectors 49, 63 are fluidly connected to each other.

In step 111, the quick coupler 30 is rotated relative to the bracket 50 such that the quick coupler body 31 is guided by the body-bracket alignment guide 70 at least partially into the bracket cavity 59. In particular, as the quick coupler body 31 is moved towards the bracket 50, the first and second axial guide bodies 81, 82 directs the quick coupler body 31 through the body-bracket alignment opening 75 and into the body-bracket alignment spacing 76. If the quick coupler body 31 contacts the first or second axial guide bodies 81, 82 during such movement the first and second body-bracket guide chamfered surfaces 73, 74 may direct it towards the centre of the bracket 50. Therefore, the body-bracket alignment guide 70 ensures that the quick coupler body 31 is within a first alignment limit relative to the bracket 50. However, prior to engagement of the axial alignment guide 80, the quick coupler body 31 may be moveable within the bracket cavity 59 by a distance within up to the first alignment limit.

In step 112, illustrated in FIG. 3, the pin alignment guide 90 may guide the at least one back pin 34, 38 towards the at least one back recess 54, 55 such that the quick coupler 30 is guided relative to the bracket 50 to fully couple the front pin-recess assembly 25. In particular, the first and second back pins 34, 38 may be directed onto and contact the first and second convex corners 93, 94. The first and second convex corners 93, 94 may direct the first and second back pins 34, 38 onto the first and second guiding edges 91, 92 towards the first and second back recesses 54, 55. In doing so, the quick coupler body 31 may be pushed backwards by this contact towards the first and second front recesses 52, 53. As a result, the first and second front pins 32, 37 may be pushed into and fully coupled in the first and second front recesses 52, 53.

In step 113, the quick coupler 30 is rotated relative to the bracket 50 such that the at least one axial ramp 83, 84 guides the bracket 50 to be located adjacent to the at least one mounting surface 85, 86. In particular, the first and/or second axial ramps 83, 84 may contact the bracket body 51, such as the first and second bracket side walls 56, 57 thereof, adjacent to the first and second back recesses 54, 55. As the quick coupler 30 is rotated further towards the coupled configuration, the bracket 50 travels along the first and/or second axial ramps 83, 84 so that the first and second mounting surface 85, 86 are located adjacent to the bracket 50.

At step 114, the quick coupler 30 and bracket 50 may be in the coupled configuration. The at least one mounting surface 85, 86 create a tight fit between them such that the quick coupler body 31 is moveable within the bracket cavity 59 by a distance up to a second alignment limit. The second alignment limit may be zero such that no movement is possible and is less than the first alignment limit. In this configuration the at least one mounting surface 85, 86 restrains or prevents relative movement between the quick coupler 30 and bracket 50 along the back pin-recess assembly axis 36 when the back pin-recess assembly 26 is coupled.

At step 115, the retaining arrangement 100 may be engaged by moving the at least one retaining arm 101 into the at least one retaining recess 102. The retaining arrangement 100 may keep the front and back pin-recess assemblies 25, 26 in their coupled configurations such that the fluid connection is maintained between the coupler and bracket fluid connectors 49, 63.

Industrial Applicability

During connection of the coupling arrangement 11 accurate alignment may be required to ensure that the coupler and bracket fluid connectors 49, 63 are fluidly connected together in a leak tight manner. In prior systems such accurate alignment may be achieved by having the coupler and bracket fluid connectors 49, 63 move relative to one another to provide the fluid connection. However, in the present disclosure the necessary alignment may be achieved by the coupling arrangement 11 itself, particularly via the first, second and pin alignment guides 70, 80, 90.

The first, second and pin alignment guides 70, 80, 90 may effectively form a three step alignment process between the quick coupler 30 and the bracket 50. The body-bracket alignment guide 70 ensures a rough initial alignment between the quick coupler 30 and the bracket 50. The pin alignment guide 90 may ensure that the front pin-recess assembly 25 is fully coupled. The axial alignment guide 80 may provide a finer alignment between the quick coupler 30 and bracket 50 by preventing movement along the back pin-recess assembly axis 36. This finer alignment ensures a tight fluid connection between the coupler and bracket fluid connectors 49, 63. The multiple step alignment process provides a suitable process for an operator to bring the quick coupler 30 and bracket 50 from the partially coupled configuration to the fully coupled configuration to provide the necessary alignment whilst enabling the operator to carry out this process by manipulating the arm arrange 14.

The invention claimed is:

1. A coupling arrangement for coupling a tool to a machine, the coupling arrangement comprising:

a quick coupler for mounting to the machine comprising a quick coupler body, the quick coupler body having first and second sides;

a bracket for mounting to the tool comprising a bracket body and a bracket cavity at least partially formed by the bracket body;

front and back pin-recess assemblies engageable to couple the quick coupler and bracket together, wherein the back pin-recess assembly comprises first and second back pins of the quick coupler extending laterally outward of the first and second sides of the quick coupler body and along a back pin-recess assembly axis;

a body-bracket alignment guide mounted to the bracket and comprising at least one body-bracket guide body configured to guide the quick coupler body at least partially into the bracket cavity during coupling of the front and back pin-recess assemblies; and an axial alignment guide mounted to the quick coupler and comprising first and second axial guide bodies extending about the first and second back pins, the first and second axial guide bodies comprising:

first and second mounting surfaces spaced laterally outward from the first and second sides of the quick coupler along the back pin-recess assembly axis, the first and second mounting surfaces configured to engage the bracket and restrain relative movement between the quick coupler and bracket along the back pin-recess assembly axis when the back pin-recess assembly is coupled; and first and second axial ramps tapering laterally outward along the back pin-recess assembly axis away from the first and second sides of the quick coupler to the first and second mounting surfaces, the first and second axial ramps configured for, during coupling of the back pin-recess assembly, guiding the bracket into engagement with the first and second mounting surfaces.

2. The coupling arrangement of claim 1 wherein the quick coupler comprises a coupling fluid connector and the bracket comprises a bracket fluid connector, wherein the first and second mounting surfaces are configured to restrain relative movement between the quick coupler and bracket along the back pin-recess assembly axis such that a fluid coupling between the coupling and bracket fluid connectors is maintained when the front and back pin-recess assemblies are coupled.

3. The coupling arrangement of claim 1 wherein the front pin-recess assembly comprises at least one front pin engageable in at least one front recess, the at least one front pin extending along a front pin-recess assembly axis.

4. The coupling arrangement of claim 3 wherein the at least one front recess is formed by at least one hook, wherein the at least one hook is configured such that the front pin-recess assembly can be uncoupled only when the back pin-recess assembly is uncoupled.

5. The coupling arrangement of claim 3 wherein the back pin-recess assembly comprises first and second back recesses and the first and second back pins are engageable in the first and second back recess when the quick coupler is rotated relative to the bracket about the front pin-recess assembly axis.

6. The coupling arrangement of claim 5 further comprising a pin alignment guide configured to, during coupling of the back pin-recess assembly, guide the first and second back pins towards the first and second back recesses such that the quick coupler is guided relative to the bracket to fully couple the at least one front pin with the at least one front recess.

7. The coupling arrangement of claim 6 wherein the pin alignment guide comprises at least one guiding edge of the bracket body, the first and second back recesses are formed in the bracket body, the first and second back pins are mounted to the quick coupler body and the at least one guiding edge extends to the first and second back recesses.

8. The coupling arrangement of claim 1 wherein the at least one body-bracket guide body comprises at least one body-bracket guide chamfered surface and the at least one body-bracket guide chamfered surface is for contacting the quick coupler body to guide the quick coupler body at least partially into the bracket cavity.

9. The coupling arrangement of claim 8 wherein at least one body-bracket guide chamfered surface comprises first and second body-bracket guide chamfered surfaces forming therebetween a body-bracket alignment opening leading to a body-bracket alignment spacing for receiving the quick coupler body, wherein body-bracket alignment spacing decreases in width from the body-bracket alignment opening.

10. The coupling arrangement of claim 1 wherein the first and second axial guide bodies are integrated with the quick coupler body or comprises at least one annular disc.

11. The coupling arrangement of claim 1 wherein the first and second axial guide bodies are located adjacent to and/or extends at least partially around the first and second back pins.

12. An apparatus comprising a machine, a tool and a coupling arrangement coupling the tool to the machine, wherein the coupling arrangement comprises:

a quick coupler comprising a quick coupler body, the quick coupler body having first and second sides;

a bracket comprising a bracket body and a bracket cavity at least partially formed by the bracket body;

front and back pin-recess assemblies engageable to couple the quick coupler and bracket together, wherein the back pin-recess assembly comprises first and second back pins of the quick coupler extending laterally outward of the first and second sides of the quick coupler body and along a back pin-recess assembly axis;

a body-bracket alignment guide mounted to the bracket and comprising at least one body-bracket guide body configured to guide the quick coupler body at least partially into the bracket cavity during coupling of the front and back pin-recess assemblies; and an axial alignment guide mounted to the quick coupler and comprising first and second axial guide bodies extending about the first and second back pins, the first and second axial guide bodies comprising:

first and second mounting surfaces spaced laterally outward from the first and second sides of the quick coupler along the back pin-recess assembly axis, the first and second mounting surfaces configured to engage the bracket and restrain relative movement between the quick coupler and bracket along the back pin-recess assembly axis when the back pin-recess assembly is coupled; and first and second axial ramps tapering laterally outward along the back pin-recess assembly axis away from the first and second sides of the quick coupler to the first and second mounting surfaces, the first and second axial ramps configured for, during coupling of the back pin-recess assembly, guiding the bracket into engagement with the first and second mounting surfaces.

13. A method of operating a coupling arrangement, the coupling arrangement comprising:

a quick coupler comprising a quick coupler body, the quick coupler body having first and second sides;

a bracket comprising a bracket body and a bracket cavity at least partially formed by the bracket body;

front and back pin-recess assemblies, wherein the back pin-recess assembly comprises first and second back pins of the quick coupler extending laterally outward of the first and second sides of the quick coupler body and along a back pin-recess assembly axis;

a body-bracket alignment guide mounted to the bracket and comprising at least one body-bracket guide body; and an axial alignment guide mounted to the quick coupler and comprising first and second axial guide bodies extending about the first and second back pins, the first and second axial guide bodies comprising first and second mounting surfaces spaced laterally outward from the first and second sides of the quick coupler along the back pin-recess assembly axis and first and second axial ramps tapering laterally outward along the back pin-recess assembly axis away from the first and second sides of the quick coupler to the first and second mounting surfaces, wherein the method comprises:

at least partially coupling the front pin-recess assembly; and coupling the back pin-recess assembly by:

rotating the quick coupler relative to the bracket such that the quick coupler body is guided by the body-bracket alignment guide at least partially into the bracket cavity;

rotating the quick coupler relative to the bracket such that the first and second axial ramps guides the bracket into engagement with the first and second mounting surfaces such that the first and second mounting surfaces engage the bracket and restrain relative movement between the quick coupler and bracket along the back pin-recess assembly axis when the back pin-recess assembly is coupled.

14. The method as claimed in claim 13 wherein the back pin-recess assembly comprises first and second back recesses and the first and second back pins are engageable in the first and second back recesses and the coupling arrangement comprises a pin alignment guide, wherein the method comprises:

during the coupling of the back pin-recess assembly, rotating the quick coupler relative to the bracket such that the pin alignment guide guides the first and second pins towards the first and second back recesses such that the quick coupler is guided relative to the bracket to fully couple the front pin-recess assembly.

15. The method as claimed in claim 13 wherein the first and second axial guide bodies forming therebetween a body-bracket alignment opening leading to a body-bracket alignment spacing and, when the quick coupler is rotated relative to the bracket such that the quick coupler body is guided by the body-bracket alignment guide at least partially into the bracket cavity, the first and second axial guide bodies direct the quick coupler body through the body-bracket alignment opening and into the body-bracket alignment spacing.

* * * * *